United States Patent [19]

Kleven et al.

[11] Patent Number: 5,057,746

[45] Date of Patent: Oct. 15, 1991

[54] CURRENT SENSING RELAY

[75] Inventors: Lawrence P. Kleven, South Attleboro, Mass.; Mark C. Carlos, North Providence, R.I.

[73] Assignee: Texas Instruments Incorporated, Dallas, Tex.

[21] Appl. No.: 596,892

[22] Filed: Oct. 12, 1990

[51] Int. Cl.[5] ..... H05B 41/00; H01H 1/28

[52] U.S. Cl. ..... 315/106; 315/107; 200/1 A; 200/283; 355/196

[58] Field of Search ..... 315/106, 107; 335/196, 335/202; 200/1 A, 283, 532, 535, 546, 559, 569

[56] References Cited

U.S. PATENT DOCUMENTS 3,671,701 6/1972 Bellmann ..... 200/283

*Primary Examiner*—David Mis

*Attorney, Agent, or Firm*—John A. Haug; James P. McAndrews; Melvin Sharp

[57] ABSTRACT

A three pole relay is shown which operates in response to the flow of normal operating current across fluorescent lamps to energize a coil which actuates a relay to open switches disposed in all of the filament lines associated with the lamp to shut off filament current while maintaining current flow across the lamps themselves.

13 Claims, 2 Drawing Sheets

CURRENT SENSING RELAY

BACKGROUND OF THE INVENTION

1 . Field of the Invention

This invention relates to a current sensing relay and, more specifically, to a plural pole relay for magnetically opening a normally closed switch of a circuit upon sensing of a predetermined electrical current.

2 . Brief Description of the Prior Art

In accordance with the prior art, filament windings of fluorescent lamps and the like remain in an energized state after lighting of the lamp since there is no provision for cutting off the filament current after commencement of lamp operation. This condition results in waste of energy as well as production of possibly unwanted heat which also must be dissipated in some manner. The prior art has attempted to alleviate this problem in several ways, such as by the use of timers in the filament circuits to cut off current to the filaments after a predetermined period of time. Other solutions to the problem are shown in Latassa (U.S. Pat. No. 4,009,412) where there is provided a secondary winding supply lamp current and a tertiary winding to supply heater current wherein a magnetic switch is provided which senses current through the secondary winding and opens the heater current circuit in response thereto. Other prior art of this type is shown in Feinberg (U.S. Pat. No. 4,568,860), Citino (U.S. Pat. No. 4,661,745), Fuller (U.S. Pat. No. 4,559,478), Regan (U.S. Pat. No. 4,339,690), Morton (U.S. Pat. No. 4,082,981) and Powell (U.S. Pat. No. 3,866,087). These prior art solutions have been subject to one or more of several problems, these including cost, the use of normally open switches wherein the switch must close to ignite the lamps initially and switch failure therefore results in fixture lighting failure. These problems have been overcome in opending application Ser. No. 07/454,592, assigned to the assignee of the present invention, in which there are disclosed and claimed several embodiments of a simple and relatively inexpensive normally closed device to cut off filament current to all starting filaments in fluorescent lamps and the like shortly after commencement of lamp operation. In that application a three pole relay is disclosed which operates in response to the flow of normal operating current across a fluorescent lamp device to energize a coil, the coil actuating the relay to open switches disposed in all of the filament lines associated with the lamps to shut off filament current while maintaining current flow across the lamp itself. In one such embodiment there is provided a can of magnetic material to which is crimped a cover of non-magnetic material to form an enclosure within the can. A coil is disposed within the can, thereagainst at one end thereof and around a center post of magnetic material. A plastic flange optionally having a shorting turn therein is secured to the other end of the coil. Also positioned within the can and abutting the interior end of the center post is a steel coin which is secured to a plastic disc. The coin/disc and plastic flange are normally biased apart by a compression spring. The center post, can and steel coin form a magnetic circuit whereby, when the coil is energized, the coin is attracted toward the coil and against the bias of the spring. A plurality of normally closed switches are maintained in the closed position by the plastic actuator when the disc is in its normal position. Upon energization of the coil, with the steel coin and plastic actuator being attracted toward the coil and away from the switches, the switches are opened to open circuits in which these switches are connected.

The switches are mounted on the cover which is formed of non-magnetic material such as plastic each of which comprises a thin flexible elongated contact blade attached at one end to the cover by a terminal which passes through a bore in the cover. The blade is adapted to move into and out of engagement with another terminal member which passes through another bore in the cover. A typical mounting of the contact blades sandwich the blade between a terminal lead and the plastic cover. The electrical quality of the type of joint is dependent upon the compression of the blade and the resiliency of the plastic which tends to cold flow over time. Compression joints are also susceptible to variations in assembly forces, plastic cold flow and rough handling which can result in a high resistance connection or a loose blade.

It is an object of the invention to provide a mounting for the contact blade which has improved reliability and which is easily assembled, inexpensive and yet one possessing low, stable electrical resistance with good retention force with the plastic cover. Another object is to provide such a mounting that is effectively impervious to contamination and environmental conditions. Yet another object is the provision of a mounting system for the elongated movable blade that has superior anti-rotational characteristics.

SUMMARY OF THE INVENTION

Briefly, in accordance with the invention, there is provided an aperture in the elongated contact blade adjacent one end thereof with an integrally formed tab extending into the aperture. The contact terminal members are formed with an intermediate shaft portion with a plurality of generally longitudinally extending curved splines formed on the outer surface of the shaft portion. The tab and splines form an interference fit with the wall of a bore in the cover to securely fix the contact blade to the cover in a given angular position immune to rotational tendencies caused by vibration and the like. The contact blade is adapted to move into and out of engagement with another contact terminal member having similar splines received in an interference fit with the walls of another bore in the cover.

DESCRIPTION OF THE PREFERRED EMBODIMENTS

Figure 1:
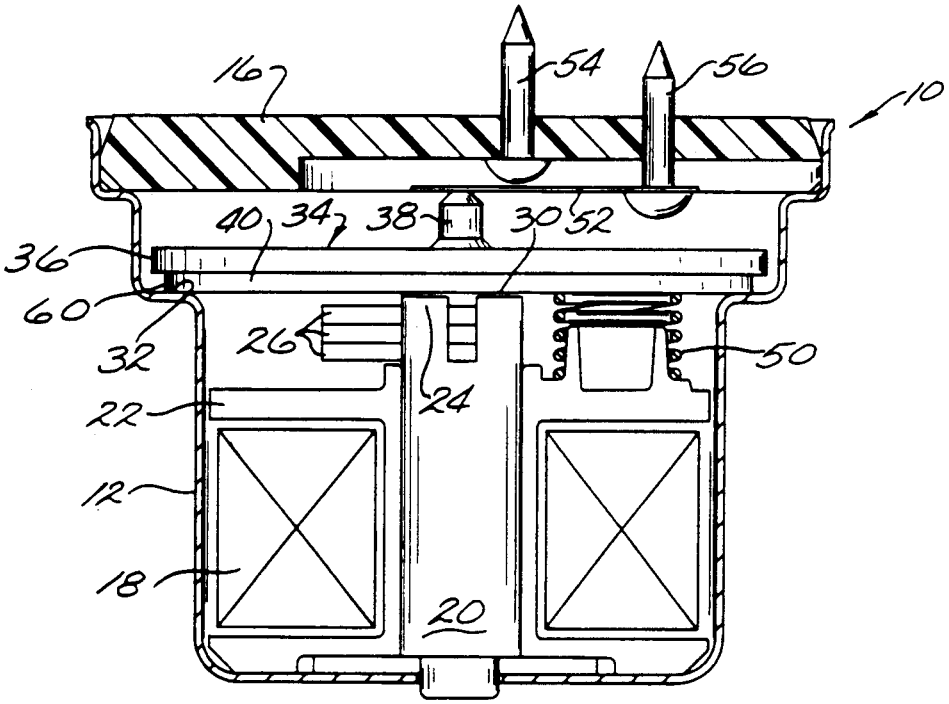
FIG. 1 is a cross sectional elevation of a device made in accordance with application Ser. No. 07/454,592 referenced supra.

Referring to the drawings, FIG. 1 shows a relay as described in application Ser. No. 07/454,592 comprising a can 12 of low magnetic permeability which is attached, as by crimping, to a cover 16 of plastic. Within can 12 is a coil 18 disposed around a center post 20 of low magnetic permeability. Coil 18 is wound on a plastic bobbin 22. A stack of essentially D-shaped members 26 of electrically conducting and low magnetic permeability material is positioned about one section 24 of a bifurcated portion of center post 20. End 30 of center post 20 is located slightly lower than a shelf 32 to provide a selected gap between the center post and a coin to be described below.

Figure 2:
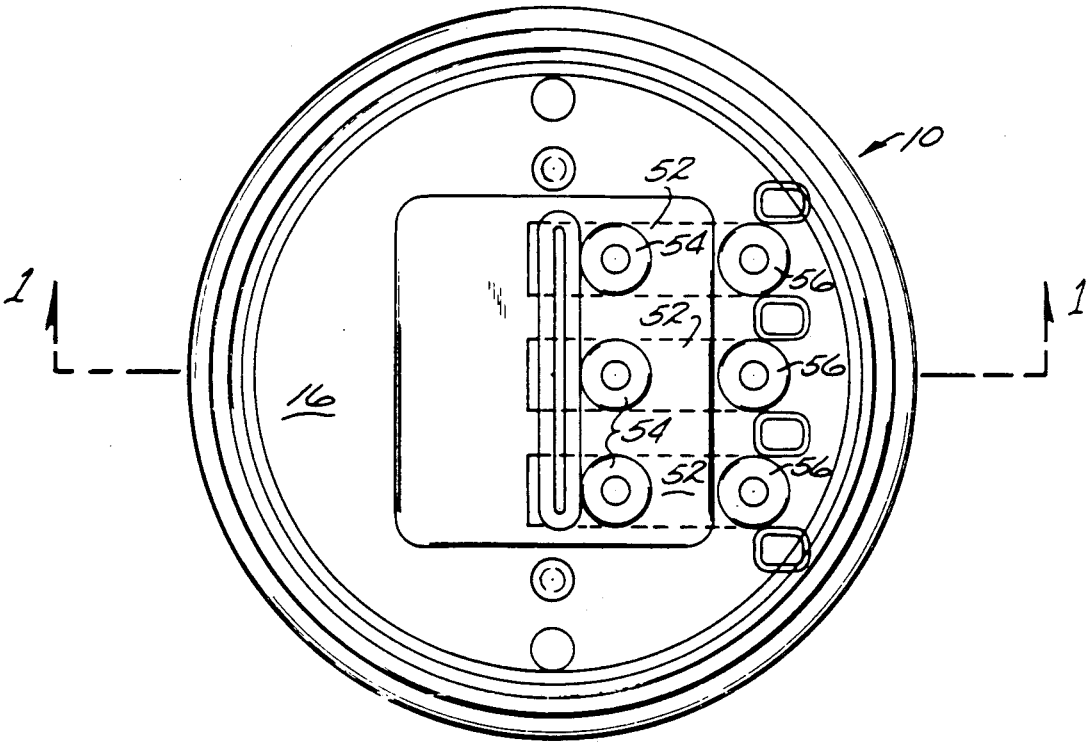
FIG. 2 is a top view of the FIG. 1 device.

An actuator assembly 34 comprising a plastic disc 36 has a rib 38 projecting upwardly from one face thereof extending laterally across a selected portion of the disc aligned with switch elements to be discussed below. Coin member 40 of steel or other suitable material of low magnetic permeability is attached to the opposite face of disc 36 in any conventional manner as by using suitable fasteners. Coin member 40 is essentially a round plate with opposed cut out portions to permit electric leads to the coil to pass therethrough. Coin member 40 is received on shelf 32 with compression spring 50 disposed between bobbin 22 and actuator disc 36 and normally biases the actuator upwardly causing coin 40 to pivot at point 60 on ledge 32. In its normal up position rib 38 biases movable contact 52 into engagement with terminal 54 to maintain the electrical circuit from terminal 56 to terminal 54 closed. There are three such switches as indicated in FIG. 2, all controlled by actuator 34.

Figure 3:
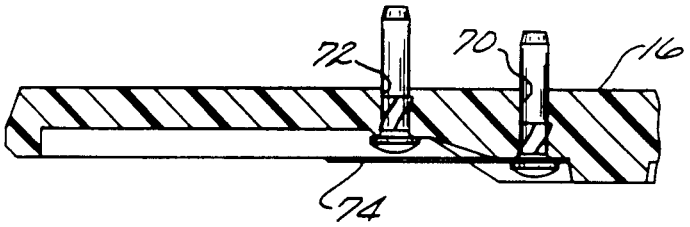
FIG. 3 is a cross section view of a portion of the cover showing one of the switches mounted in the cover.
Figure 4:
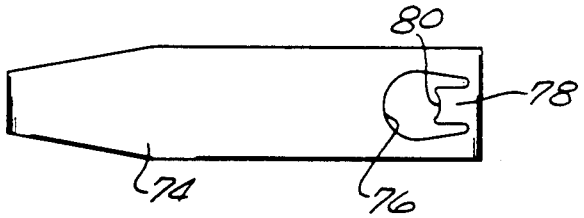
FIG. 4 is a top plan view of a contact blade used in the FIG. 3 switch.
Figure 5:
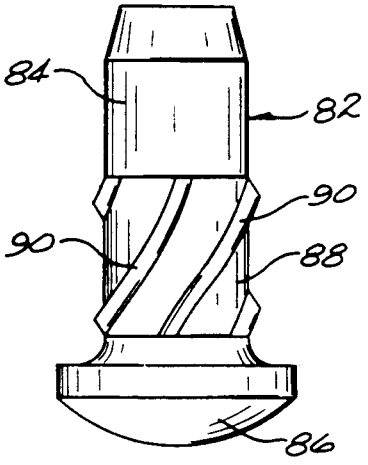
FIG. 5 is a view of a contact terminal member used in the FIG. 3 switch.

As seen in FIGS. 3-5 cover 16 is provided with first and second bores 70, 72 preferably of the same diameter for each switch mounted thereon. In accordance with the present invention a contact blade 74 formed of flexible electrically conductive material such as 0.002 thick stainless steel preferably provided with a silver coating thereon is formed with an aperture 76 adjacent one end thereof. A tab 78 is formed integrally with blade 74 and projects into the aperture. The distal free end of tab 78 is formed with a curve having a radius 80 less than that of the shaft which is received in aperture 76 to be discussed below.

Contact terminal members 82, received in both bores 70, 72, comprise a terminal end portion 84, a contact head portion 86 and an intermediate shaft portion 88. Contact head portion 86 is preferably formed with a convex curved end surface to serve as an engagement surface with contact blade 74. Intermediate shaft portion 88 has a diameter which is selected so that it forms an interference fit with the walls of bores 70, 72. A plurality of generally longitudinally extending splines 90 are formed in the shaft but at a selected angle of approximately 30° with the longitudinal axis of the shaft. Although the specific number of splines is a matter of choice six splines evenly spaced about the periphery of the shaft is preferred and extend along a curved line. In a switch made in accordance with the invention the shafts had a diameter between 0.053 and 0.054 inches and the height of the splines was between approximately 0.0035 and 0.004 inches and the radius 80 of tab portion 78 was between approximately 0.020 and 0.021 inches.

A contact terminal member 82 is forced into bore 72 in each switch and then aperture 76 of a contact blade 74 is placed over each bore 70 properly aligned with its respective bore 72 and another contact terminal 82 is inserted through the respective aperture 76 and bore 70 forcing tab 80 into the bore and forming an interference fit along with splines 90 to effect a positive retention of contact blade 74 in a selected angular orientation, i.e. in alignment with contact terminal member in bore 72.

Actuator 38 is adapted to engage the lower surface of contact blades 74 on the free end side of the blades beyond the contact terminal member in bores 72.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

We claim:

1. A relay for disconnecting fluorescent lamp filaments from an associated filament circuit comprising;

(a) a generally cup shaped housing having a bottom wall and a depending cylindrical side wall, the side wall having a free distal end portion formed with an annular ledge lying in a plane parallel with the bottom wall;

(b) a magnetic flux producing means disposed within the housing, the flux producing means having a center post extending essentially from the bottom wall upwardly to a point slightly below said plane;

(c) actuator means including a coin member of relatively high magnetic permeability disposed within the housing and movable toward the magnetic flux producing means;

(d) spring means mounted within the housing to place an upward bias on the actuator means; and (e) switch means including a cover member composed of electrically insulative resinous material received on top of the cup shaped housing, a plurality of switches mounted on the cover member, each switch comprising first and second contact terminal members received in respective bores extending through the cover member, the contact members each having a contact portion at one end, a terminal portion at an opposite end joined by an intermediate shaft portion, the shaft portion having a plurality of splines which extend at an angle to the longitudinal axis of the shaft, the shafts having a diameter selected to form an interference fit with its respective bore, an elongated contact blade formed of electrically conductive, flexible material having an aperture adjacent one end thereof, a tab portion of the blade projecting into the aperture, the first contact terminal member received through the aperture forcing the tab into the respective bore in the cover member forming an interference fit in the bore along with the splines, the blade being movable into and out of engagement with the second contact terminal member, the actuator means normally biasing each movable contact blade into engagement with its associated contact terminal to maintain each of the switches in the normally closed state.

2. A relay according to claim 1 in which the contact blade is composed of stainless steel.

3. A relay according to claim 2 in which the contact blade is coated with a silver layer.

4. A relay according to claim 1 in which the splines extend along a curved line.

5. A relay according to claim 1 in which the splines form an angle with the longitudinal axis of the shaft of approximately 30°.

6. A relay according to claim 1 in which there are approximately six splines spaced about the periphery of the shaft.

7. A relay according to claim 1 in which the tab has a distal free end formed with a concave curved surface having a radius less than the radius of the shaft.

8. Switch apparatus comprising a housing member of resinous material, first and second contact terminal members received in respective bores extending through the housing member, the contact terminal members each having a head portion at one end, a terminal portion at an opposite end joined by an intermediate shaft portion, the shaft portion having a plurality of splines thereon, the shaft having a diameter selected to form an interference fit with its respective bore, an elongated contact blade formed of electrically conductive, flexible material having an aperture adjacent one end thereof, a tab portion of the blade projecting into the aperture, the first contact terminal member received through the aperture forcing the tab into the respective bore in the housing member forming an interference fit in the bore along with the splines, the blade being movable into and out of engagement with the second contact terminal member, and actuator means to selectively bias the contact blade into engagement with the second contact terminal.

9. Switch apparatus according to claim 8 in which the tab has a distal free end formed with a concave curved surface having a radius less than the radius of the shaft.

10. Switch apparatus according to claim 8 in which the contact blade is composed of stainless steel.

11. Switch apparatus according to claim 8 in which the splines extend along a curved line.

12. Switch apparatus according to claim 8 in which the splines form an angle with the longitudinal axis of the shaft of approximately 30°.

13. Switch apparatus according to claim 8 in which there are approximately six splines spaced about the periphery of the shaft.

* * * * *